US010041301B2

(12) United States Patent
Jones

(10) Patent No.: US 10,041,301 B2
(45) Date of Patent: Aug. 7, 2018

(54) VEHICULAR AUGER IMPLEMENT

(71) Applicant: Billy Goat Industries, Inc., Lee's Summit, MO (US)

(72) Inventor: Kirk Jones, Vista, CA (US)

(73) Assignee: Billy Goat Industries, Inc., Lee's Summit, MO (US)

( * ) Notice: Subject to any disclaimer, the term of this patent is extended or adjusted under 35 U.S.C. 154(b) by 409 days.

(21) Appl. No.: 14/155,287

(22) Filed: Jan. 14, 2014

(65) Prior Publication Data

US 2014/0251697 A1 Sep. 11, 2014

Related U.S. Application Data

(60) Provisional application No. 61/752,030, filed on Jan. 14, 2013.

(51) Int. Cl.
*E21B 7/02* (2006.01)

(52) U.S. Cl.
CPC ..... *E21B 7/027* (2013.01)

(58) Field of Classification Search
CPC ..... E21B 7/027; E21B 7/02; E21C 1/14
See application file for complete search history.

(56) References Cited

U.S. PATENT DOCUMENTS

| | | | | |
|---|---|---|---|---|
| 2,474,981 A | | 7/1949 | McCardell | |
| 2,562,276 A | | 7/1951 | Kandle | |
| 2,639,982 A | | 5/1953 | Jones | |
| 2,774,568 A | | 12/1956 | Jones | |
| 3,367,427 A | | 2/1968 | Baumgardner | |
| 3,391,890 A | | 7/1968 | Perbal | |
| 3,700,045 A | | 10/1972 | Coontz | |
| 3,789,931 A | | 2/1974 | Quinn | |
| 4,961,471 A | | 10/1990 | Ovens | |
| 5,158,146 A | | 10/1992 | Fuller | |
| 5,363,925 A | | 11/1994 | Gallagher | |
| 5,542,476 A | | 8/1996 | Hansen | |
| 5,556,217 A | * | 9/1996 | Deyo | E02F 3/3604 173/185 |
| 5,836,402 A | | 11/1998 | Jones | |
| 6,056,065 A | | 5/2000 | Campbell et al. | |

(Continued)

FOREIGN PATENT DOCUMENTS

| | | | | |
|---|---|---|---|---|
| EP | 0774542 A1 | * | 5/1997 | E01C 19/405 |
| WO | WO 2010114462 A1 | * | 10/2010 | E02D 1/025 |

*Primary Examiner* — Giovanna C. Wright
*Assistant Examiner* — Manuel C Portocarrero
(74) *Attorney, Agent, or Firm* — Lathrop Gage L.L.P.

(57) ABSTRACT

A mobile auger implement is used with an auger bit and a motor for driving the bit. The implement includes an adjustable base, a central articulating section having a double 4-bar linkage connected to the adjustable base and providing a range of movement, and an auger support and control section connected to the central articulating section and providing an operator handle for guiding the bit. The double 4-bar linkage includes central, base, and distal links and four bars each having a fixed length and being connected to the central link. The first and second bars are parallel to one another at all times, and the third and fourth bars are parallel to one another at all times. The base link is unable to tilt relative to the distal link, such that the auger maintains an angular orientation. Adjustment of the adjustable base affects the angular orientation of the auger.

16 Claims, 9 Drawing Sheets

(56) References Cited

U.S. PATENT DOCUMENTS

| | | | | |
|---|---|---|---|---|
| 6,260,633 | B1 | 7/2001 | Machek et al. | |
| 6,305,882 | B1 | 10/2001 | Coast et al. | |
| 6,675,916 | B1 | 1/2004 | Matthews | |
| 6,681,470 | B1 | 1/2004 | Scott | |
| 6,868,923 | B2 | 3/2005 | Mitchell | |
| 6,889,779 | B2 | 5/2005 | Skarlupka, IV et al. | |
| 7,387,172 | B2 | 6/2008 | Vandeligt et al. | |
| 7,935,192 | B2 * | 5/2011 | Silverman | B08B 9/045 134/18 |
| 7,987,923 | B1 | 8/2011 | Hurley | |
| 8,397,835 | B1 | 3/2013 | Lyngaas | |
| 2004/0031617 | A1 | 2/2004 | Skarlupka, IV et al. | |
| 2004/0195285 | A1 | 10/2004 | Pinard | |
| 2006/0011358 | A1 * | 1/2006 | Motosko | A01B 1/065 172/25 |
| 2010/0224746 | A1 | 9/2010 | Johnson et al. | |
| 2011/0266411 | A1 * | 11/2011 | Silverberg | 248/634 |

* cited by examiner

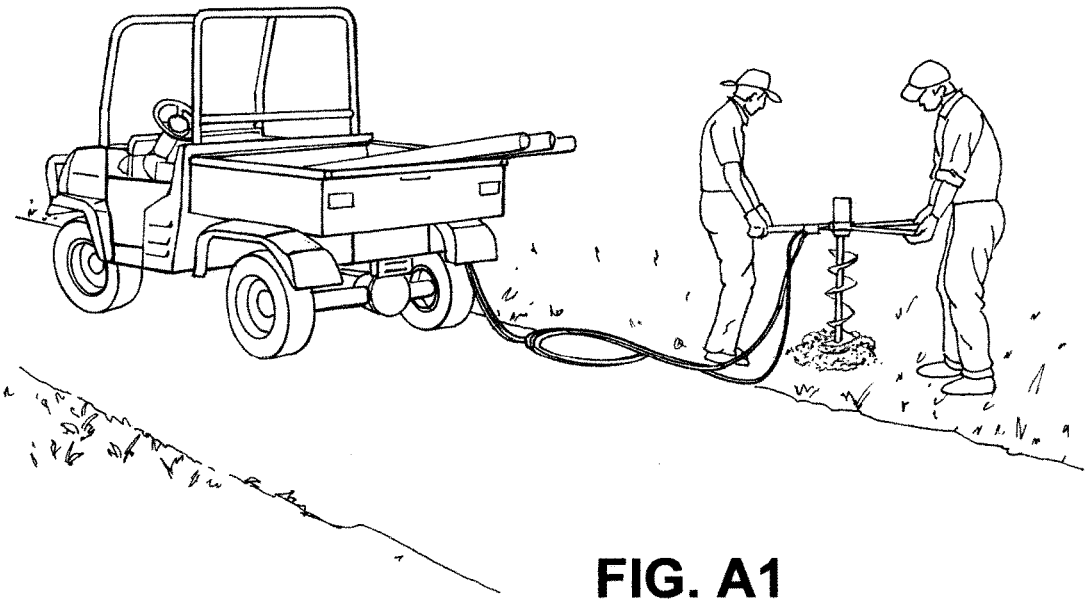
FIG. A1
Prior Art
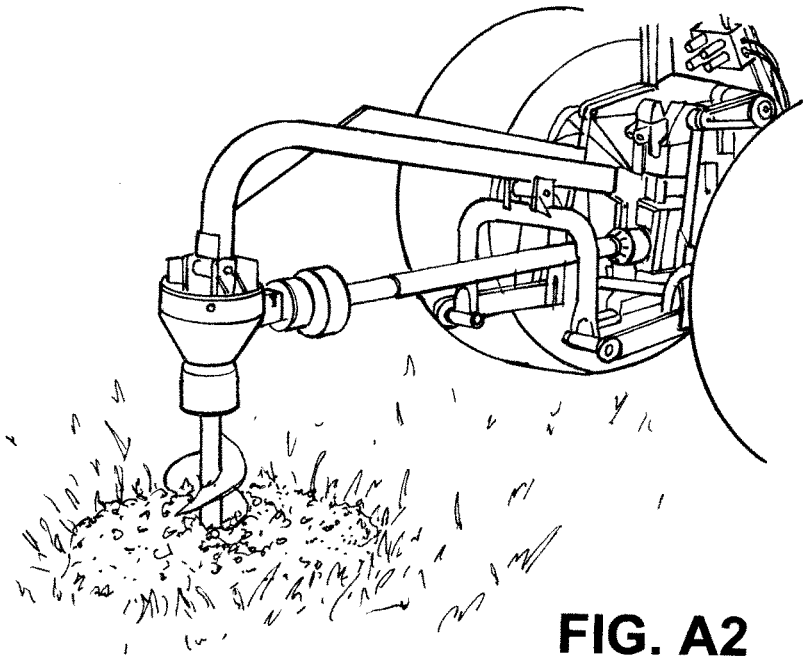
FIG. A2
Prior Art

VEHICULAR AUGER IMPLEMENT

RELATED APPLICATIONS

This application claims the benefit of U.S. Provisional Patent Application Ser. No. 61/752,030, filed Jan. 14, 2013.

BACKGROUND OF THE INVENTION

Field of the Invention

The invention relates to augers, and, more particularly, to a vehicular auger implement for use with a vehicle such as an ATV.

Description of the Prior Art

High power augers that provide an output torque of about 200 to 300 ft. lbs. are traditionally operated by two people. These are the earth augers that drive long and large diameter large auger bits with, for example, a 1¼ in. square female snap connection, a 1⅜" hex male pinned connection, or other robust connector. They are usually heavy, gasoline powered, and require two people to manually position and attempt to keep the unit from spinning out of their hands by their shear strength. They must also attempt keep the auger drilling vertical by sight. These types of augers are very dangerous for the operators and very exhausting to use. FIG. A1 depicts a typical two-man auger being manipulated by hand, one being driven by a hydraulic circuit.

Another style is to have a self contained "one man" operated unit that is mounted on wheels. These are more expensive and really require a least two people if the ground in not flat as these units are very heavy and are virtually impossible to keep positioned by one person on a slope.

In other cases, the auger is theoretically enabled for one-man operation by being partially supported by a telescoping "torque tube" that is attached to a trailer hitch or other anchored object. In use, however, the torque tube pivots about its end connections and the operator must strive to adjust the relative angle of the auger in order to move the auger straight up and straight down.

In another prior art arrangement as shown in FIG. A2 (i.e. on the back of a tractor), the auger is connected to a 3-point hitch and driven by a mechanical power take-off. As shown, the auger is pivoted about on a heavy-duty support member such that the auger bit tends to rotate around the support members pivot point as it drills down into the earth. In typical operation, this still requires two people—a spotter and a driver. The spotter guides the driver in order to position the point of the auger bit over the desired bore and then the team begins to bore the hole with the auger bit. As the auger bit advances into the soil, the gear box begins to pivot away from the tractor around the link (see arrow) and, because of this, the driver inches forward to prevent the auger tip from moving toward the tractor's original location.

Vehicular auger mounts have been developed for mounting augers to vehicles, including smaller vehicles such as all-terrain vehicles (ATVs). A typical ATV is a small open single-rider vehicle having four wheels and generally designed for off-road use on various types of terrain or rough ground. The American National Standards Institute (ANSI) defines an ATV as a vehicle that travels on low-pressure tires, with a seat that is straddled by the operator, along with motorcycle-like handlebars for steering control. ATVs usually do not have windshields.

Other vehicles of similar size, power, and all-terrain capability have different names. For example, a UTV (utility task vehicle), sometimes called a "side-by-side," is a four-wheel drive vehicle that usually is slightly larger than an ATV, usually has a conventional steering wheel, and provides seating for 2 or 4 people in a side-by-side arrangement. UTVs sometimes have windshields. UTVs often have small truck beds and, as a result, are popular among golf course maintenance personnel, parks and recreation departments, and any other users who need to travel over uneven terrain with people and materials.

ATVs and UTVs are traditionally sold by well-known manufacturers such as HONDA®, KAWASAKI®, ARCTIC CAT®, YAMAHA®, CAN-AM®, SUZUKI®, and POLARIS®. For the sake of simplicity, this application will refer to vehicles in this general class as "ATVs."

An ATV is usually powered by an internal combustion engine that runs on gasoline or other suitable fuel (e.g. propane, diesel fuel, etc.) For moving the ATV, the engine is usually coupled to a pair of rear-drive wheels via the engine's drive shaft and an intermediate transmission. Some ATVs even include four wheel drive power train.

ATV's are often used for recreational purposes, but ATV manufacturer are also making models that are well-suited for use as general purpose work vehicles or utility vehicles (e.g. on a farm or other large property, for military purposes, etc.).

Due to the ever increasing demand to use ATVs as work vehicles, various implements have been designed to convert ATVs into more useful vehicles, such as lawn mowers, log splitters, electric generators, etc. However, these attachments normally came with significant drawbacks in that duplicate engines were needed to run the separate implements that may or may not be pulled by the ATV, which is very costly and needlessly weighs down the ATV. Conventional implements are custom installed and are cumbersome and time consuming to utilize in that they are required to be bolted onto the ATV engine and have to be completely unbolted and disassembled to operate the ATV in a normal function when not using the implement.

U.S. Pat. Nos. 7,284,625 and 7,600,594, invented by applicant and hereby incorporated by reference as if fully set forth herein, disclose a unique hydraulic power take-off (PTO) system for use with an ATV. The two patents more specifically disclose a quick connect/disconnect assembly for allowing a power transfer unit to be connected to and disconnected from an ATV. The power transfer unit detachably connects to an output shaft associated with the rotation of the ATV's engine (usually the engine's drive shaft) and then powers an implement connected to, carried by, or located near the ATV. The power transfer unit beneficially eliminates the need to have separate engines for the implements.

The preferred power transfer unit is a hydraulic pump that forces fluid through a hydraulic circuit and drives a hydraulic motor associated with the implement. The exemplary implements that could be driven with the hydraulic power transfer unit included a lawn mower, a water sprayer, a snow blower, an air compressor, a water pump, a post-hole digger, an electric generator, a wood chipper, and a log splitter.

In the typical ATV, the engine includes an engine case and a drive shaft or other engine shaft that extends from the engine case. Typically, the engine's drive shaft is accessible beneath the drive shaft cover or starter cover that is historically associated with a so-called "Recoil Starter." In earlier ATVs, the drive shaft cover sometimes included a pull handle to permit the operator to hand start the engine in the event that the electrically-driven starter was inoperable. In more recent ATVs, however, the drive shaft cover often does not include a pull handle and the cover is just a cover.

In one commercial embodiment made according to the '625 and '594 patents, designed for retrofitting a hydraulic power take-off unit to a BRUTE FORCE® model ATV manufactured by KAWASAKI®, the starter cover is removed and a drive plate that carries a female coupler is retrofitted to the drive shaft. Then, the starter cover is replaced with a quick connect case that provides suitable quick connect features along its periphery and has a central aperture that exposes an outward face of the female coupler. Using a suitable quick connect/disconnect mechanism that mates with the features on the case, the hydraulic pump is connected to the quick connect case and, inside of the case, the hydraulic pump's input shaft and associated male coupler are mated with the female coupler.

The quick connect assembly and hydraulic power transfer unit disclosed in the '625 and '594 patents advantageously allows an ATV owner to power various implements by using the ATV's own engine—without requiring a duplicate engine on the implement.

Auger mounts have been developed for all-terrain vehicles (ATVs) as shown, for example, in U.S. Pat. Nos. 5,836,402, 6,681,470 and 8,397,835. In the vehicular auger mounts disclosed in the foregoing patents, however, the auger-holder has been based on a less than optimal slide-like mechanism that makes it somewhat difficult to position the auger and maintain a vertical path in a wide variety of circumstances.

Accordingly, a need has been developed in the art to provide a vehicular auger implement that allows the operator to easily position the auger and keeps the auger bit vertical as it goes deeper and deeper into the soil.

BRIEF SUMMARY OF THE INVENTION

It is a primary object of this invention to provide an improved vehicular auger implement.

In a preferred embodiment, the invention comprises an auger implement for vehicular attachment and moveable support of an auger having a motor and an auger bit driven by the motor, comprising: a vehicular mount; a central articulating section connected to the vehicular mount and providing a range of movement; an auger support and control section connected to the central articulating section and providing an operator handle for guiding the auger within the range of the central articulating section and a hand-operated switch for energizing the motor; wherein the central articulating section comprises a counter balanced double 4 bar linkage.

While the apparatus and related method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. A1 show a prior art two-man auger.

FIG. A2 shows a prior art auger connected to a three-point hitch on the rear of a tractor having a mechanical power take-off shaft.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 4:
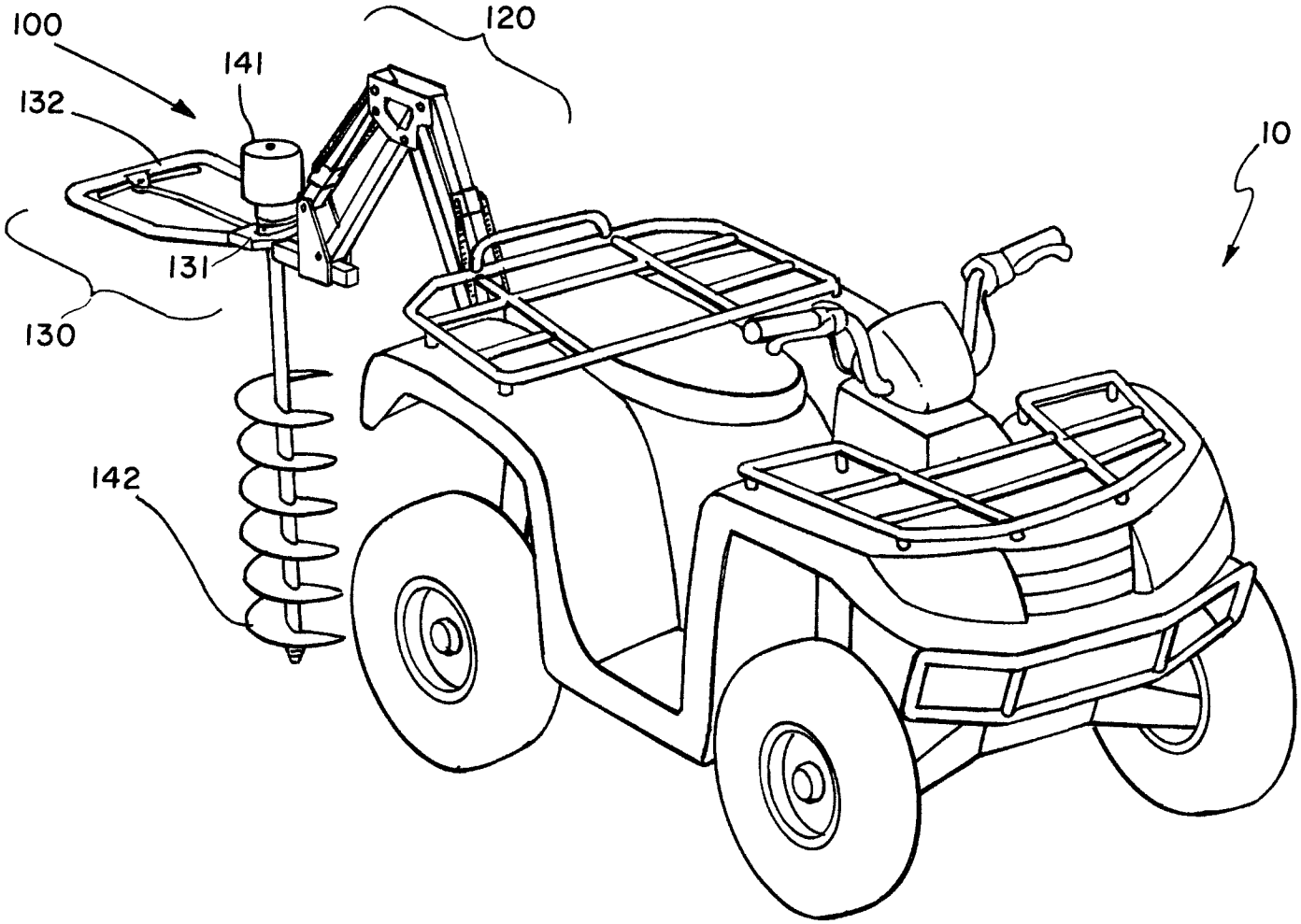
FIG. 4 is a front perspective view of the vehicular auger implement 100 of FIG. 1 mounted to the rear of the ATV 10.
Figure 5:
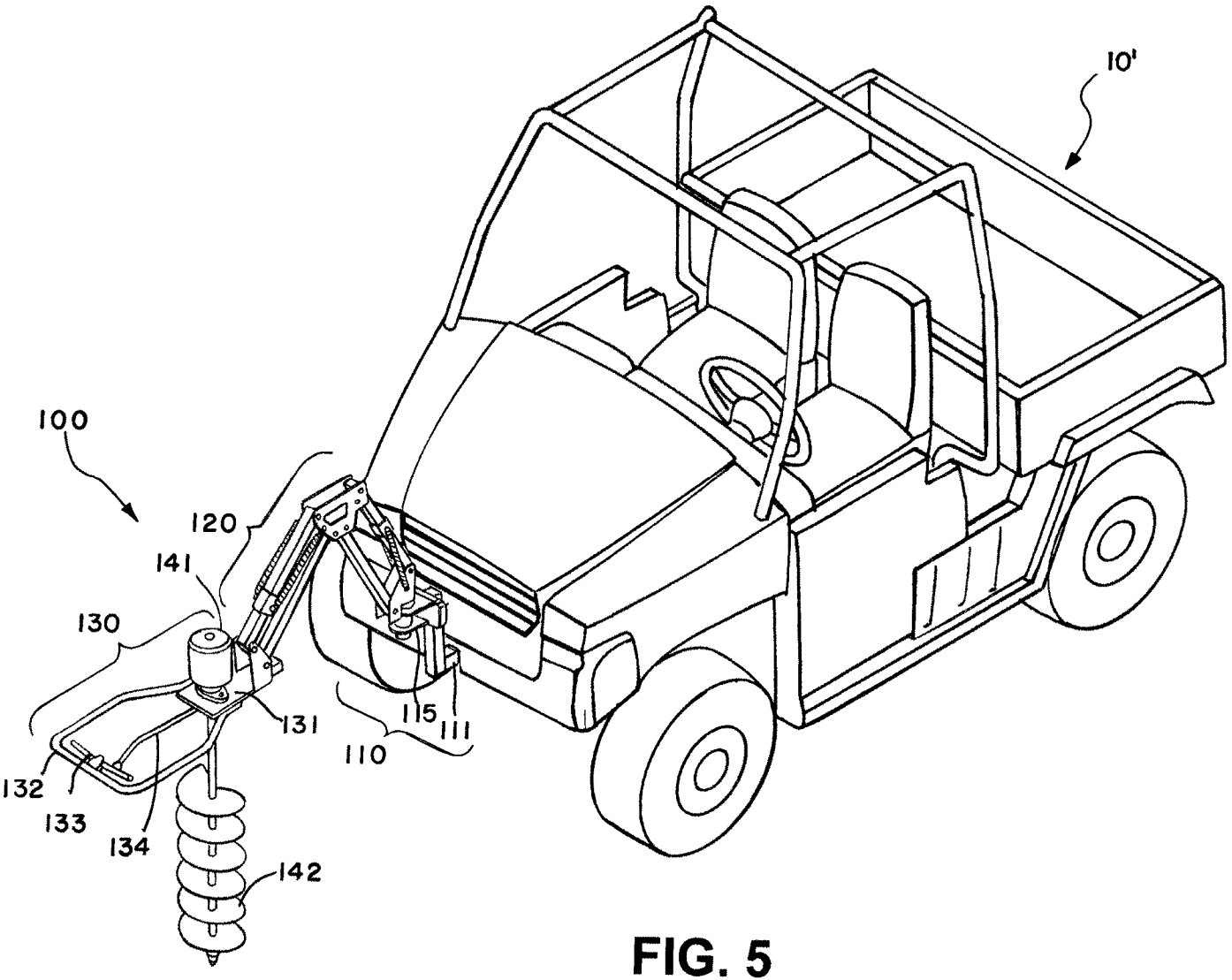
FIG. 5 is a front perspective view of the vehicular auger implement 100 of FIG. 1 mounted to a tow receiver 11' located at the front of a side-by-side UTV 10'.
Figure 6:
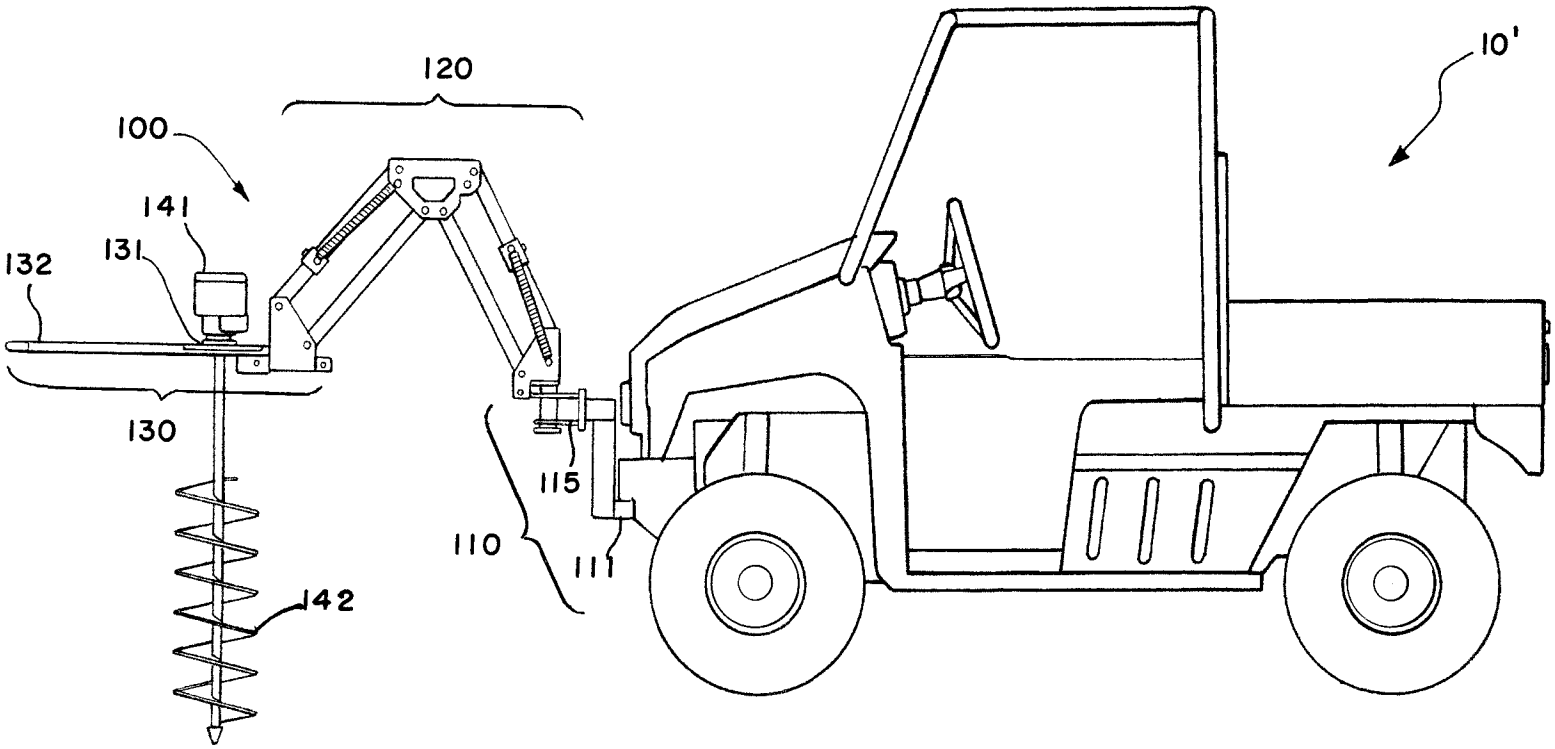
FIG. 6 is a left side view of the vehicular auger implement 100 of FIG. 1 mounted to the front of the UTV 10'.
Figure 7:
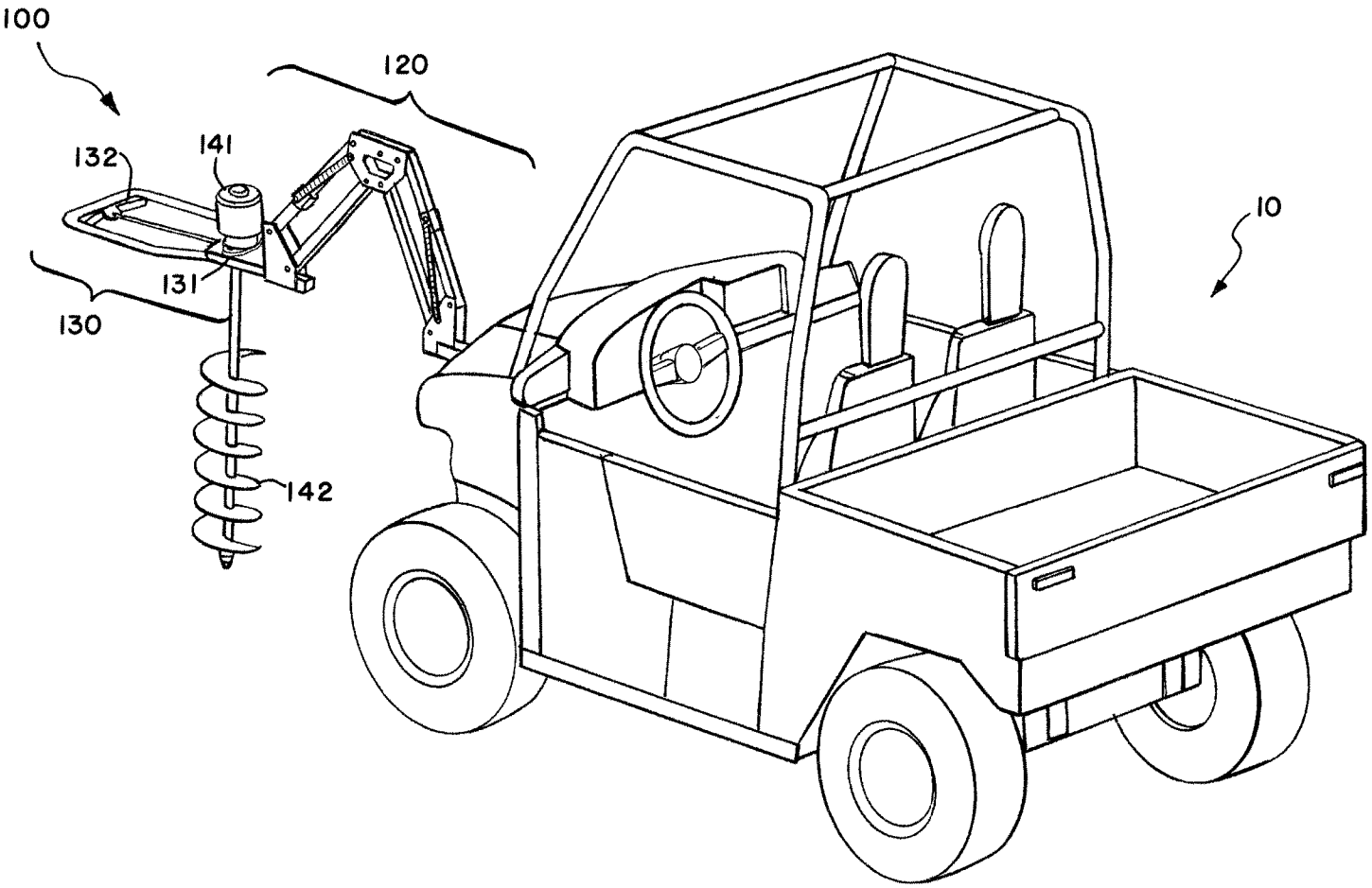
FIG. 7 is a front perspective view of the vehicular auger implement 100 of FIG. 1 mounted to the front of the UTV 10.

A presently preferred embodiment of the invention, as shown in the figures, is an auger implement 100 for a vehicle such as an ATV 10 (FIGS. 2 to 4) or UTV 10' (FIGS. 5 to 7, plus 8A and 8B). In more detail, the auger implement 100 comprises a central articulating section 120 formed from a spring or gas shock counter balanced double 4 bar linkage that pivotally mounts onto a vehicular mount 110 that provides a 2 axis base 100 or, alternatively, a full gimbal base. This complete unit is then mounted to a mobile power source such as an ATV, UTV, or tractor having a power source, e.g. a hydraulic power take-off arrangement, or for that matter any vehicle, allowing for a single operator to drill vertical holes independent of the slope of the terrain the vehicle is on.

Figures 1, 1B:
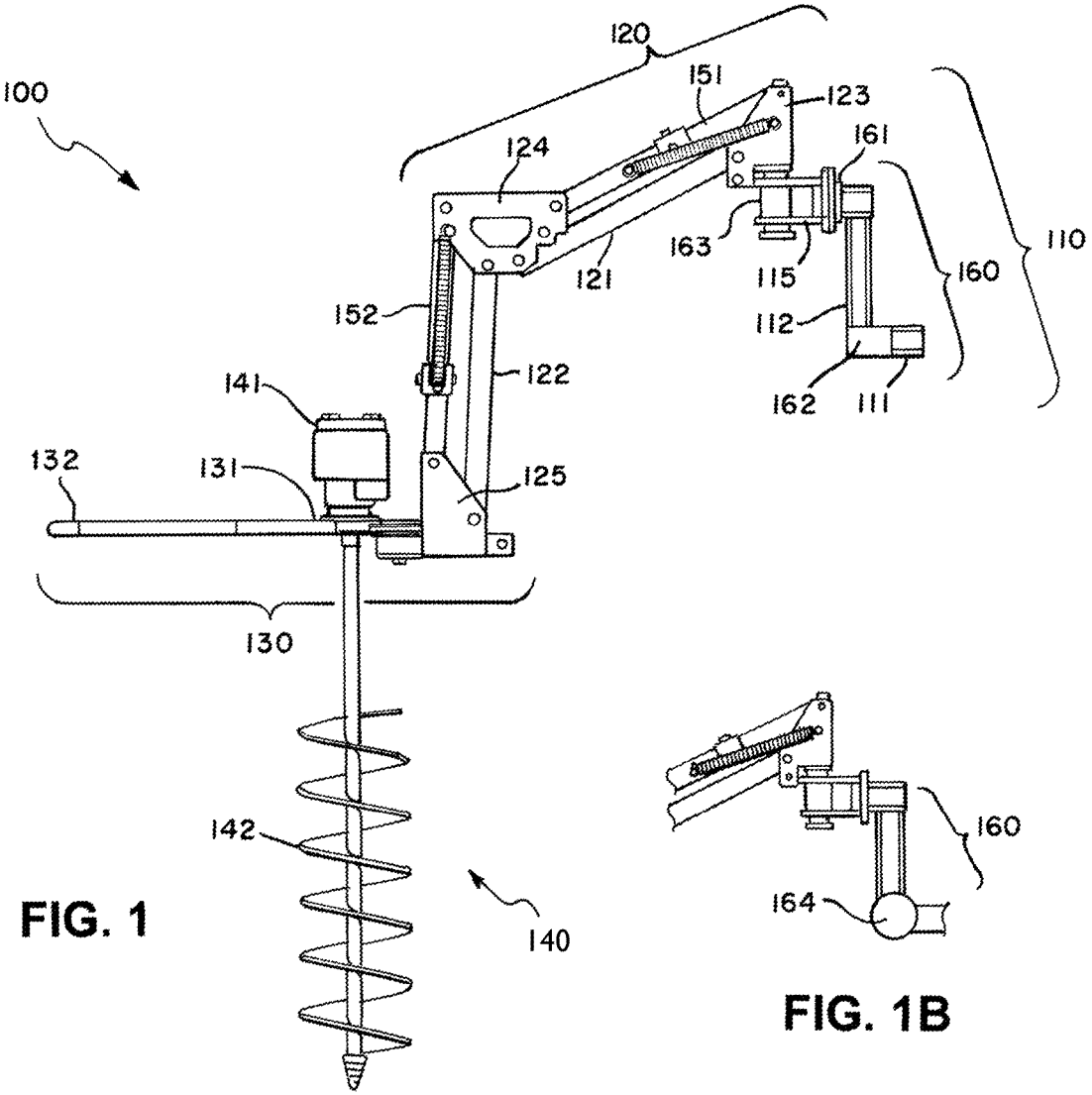
FIG. 1 is a side view of a first preferred vehicular auger implement 100 having a vehicular mount 100 with a proximal end comprised of a tongue 110 for attachment to the vehicle's tow hitch receiver (not shown), a distal end 115, and three pivot connections 161, 162, 163, a central articulating section 120 that connects to the mount's distal end 115 and is uniquely formed from a double 4-bar linkage arrangement 121, 122, an auger support and control section 130 including a mounting plate 131 and a handle 132, and an auger 140 including a hydraulic motor 141 and an auger bit 142.
FIG. 1B shows an alternative embodiment where a single connecting mechanism 164 provides a full gimbal base 164.
Figure 2:
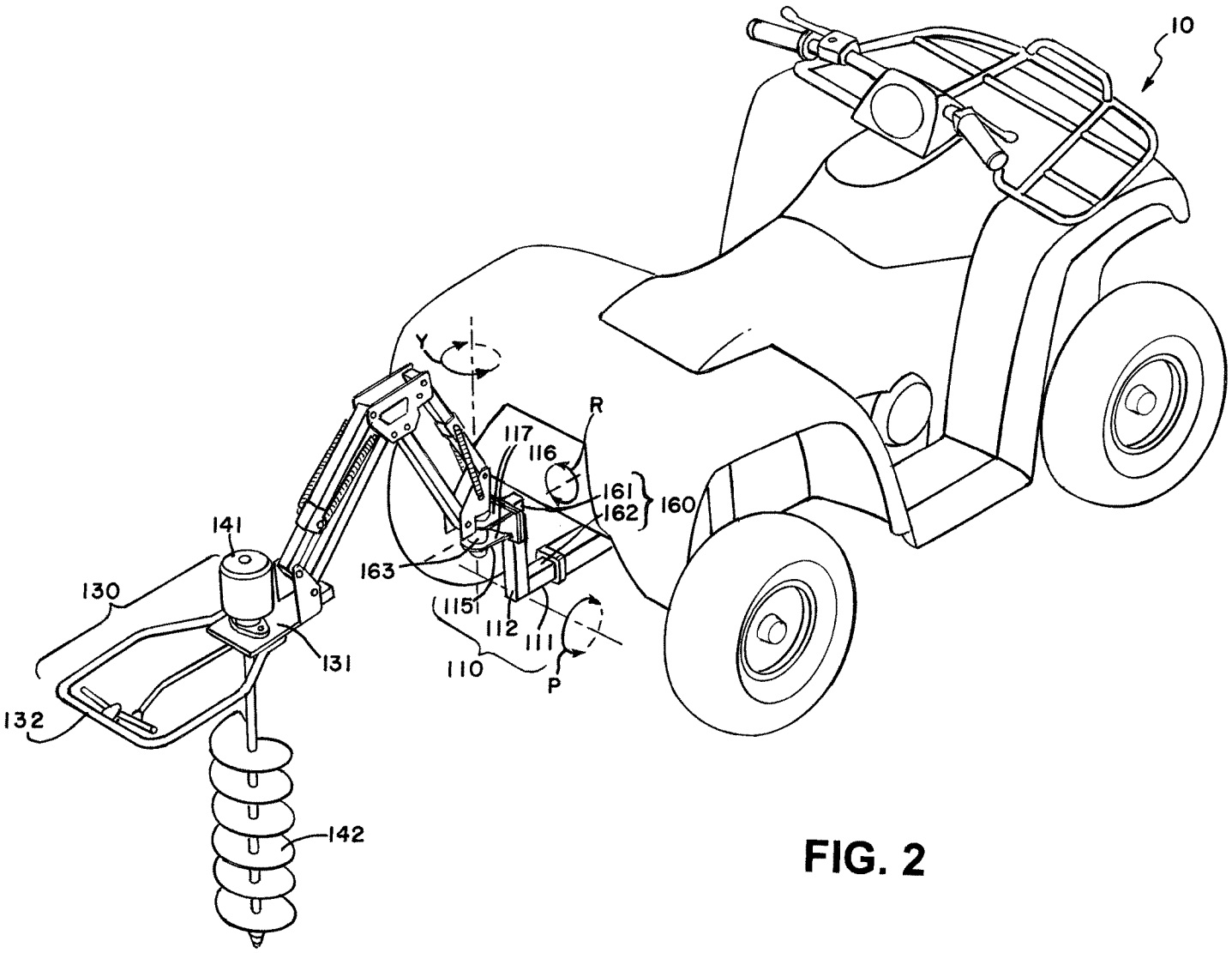
FIG. 2 is a rear perspective view of the vehicular auger implement 100 of FIG. 1 mounted to a tow receiver 11 located at the rear of an ATV 10.
Figure 3:
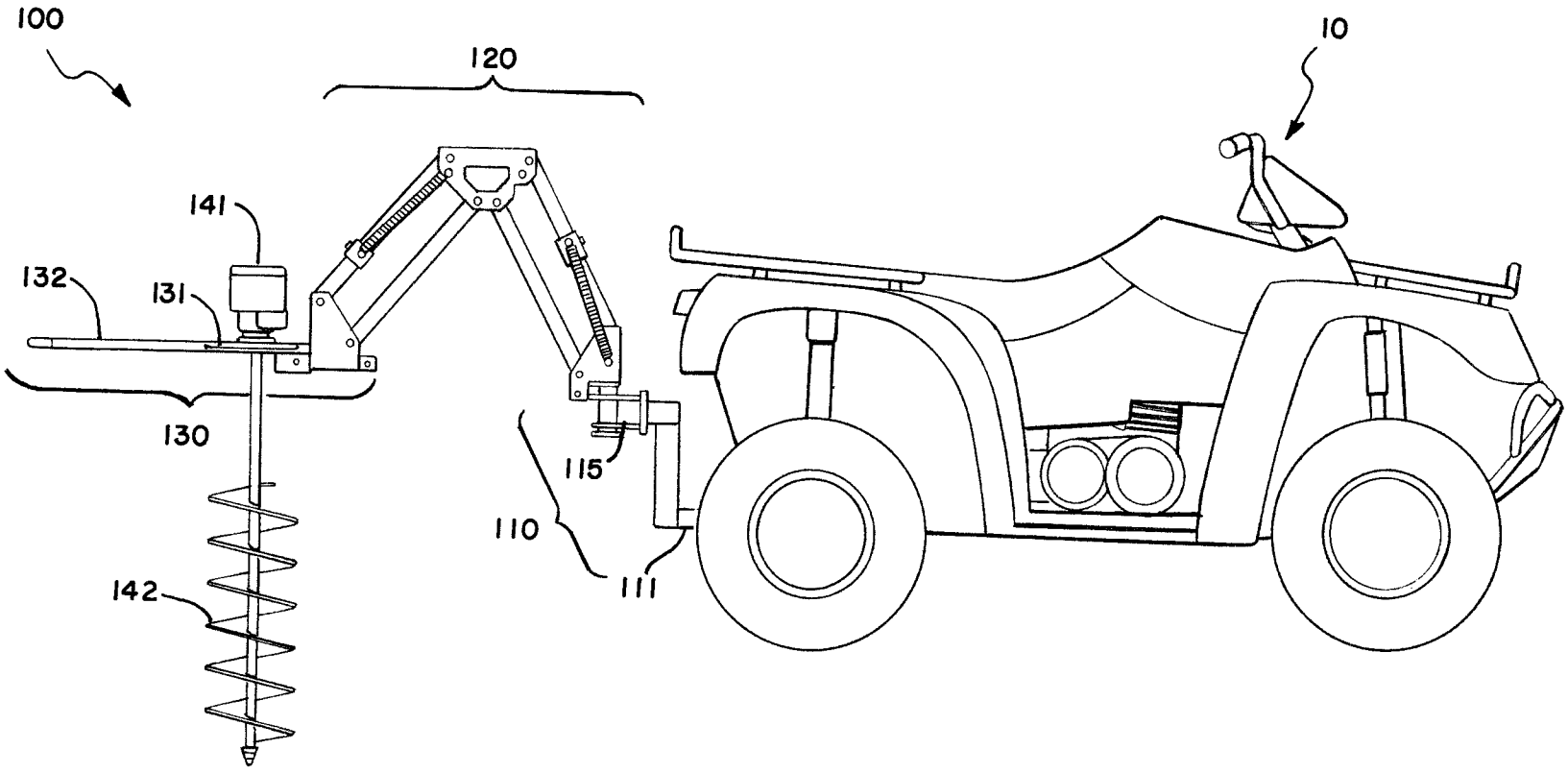
FIG. 3 is a right side view of the vehicular auger implement 100 of FIG. 1 mounted to the rear of the ATV 10.
Figure 8A:
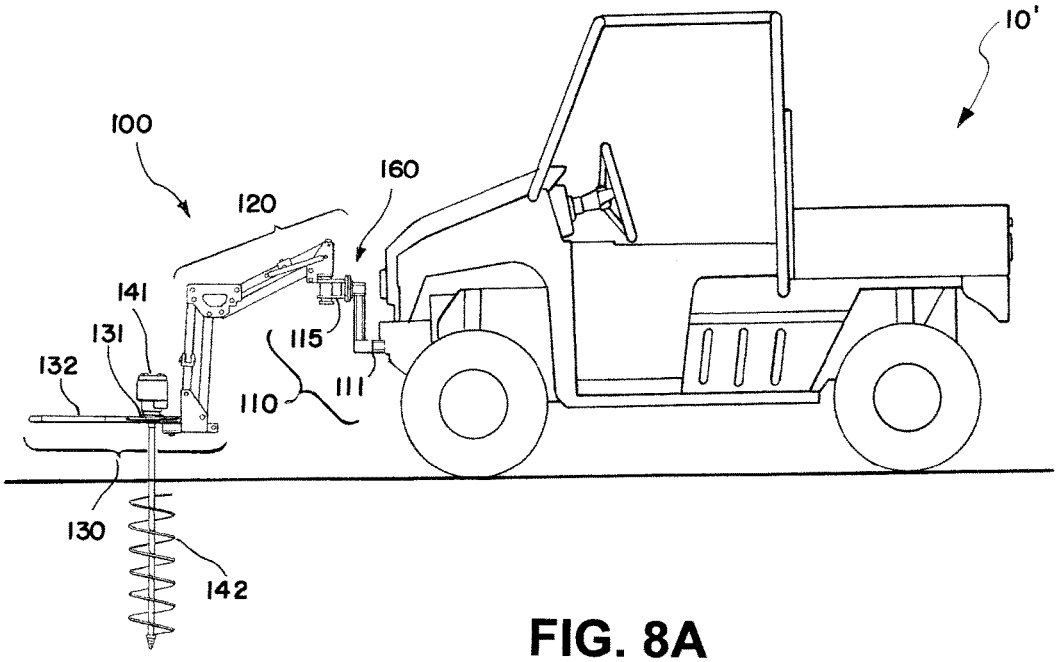
FIGS. 8A and 8B collectively illustrate how the central articulating section 120 vertically guides the auger bit 142 into and out of the soil.
Figure 8B:
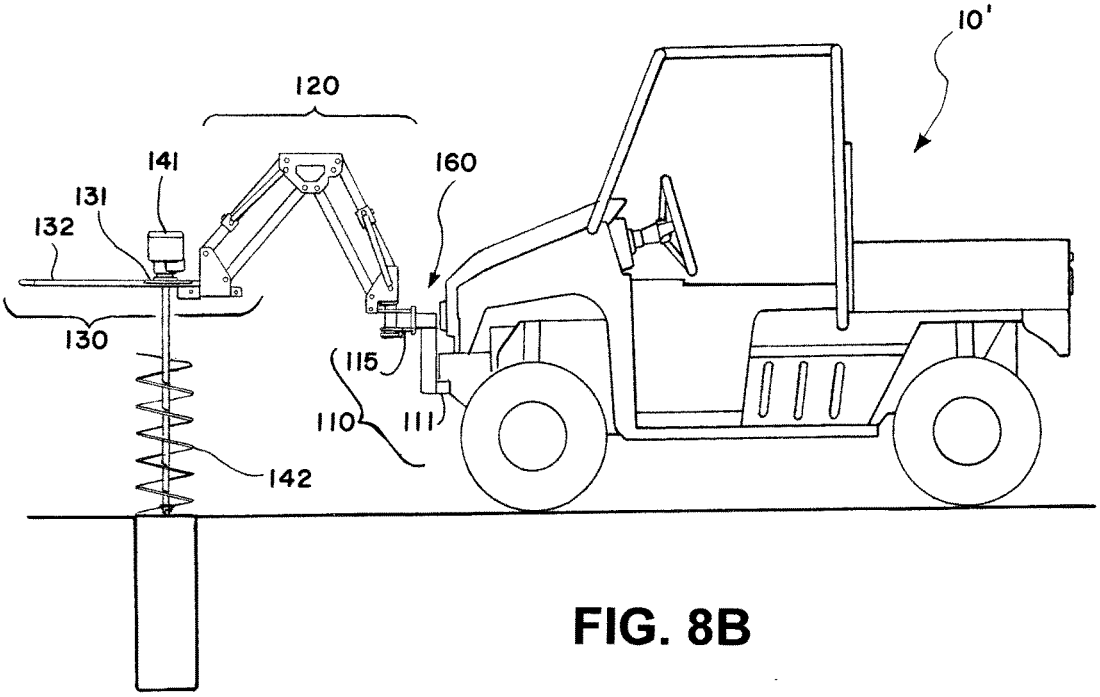

FIG. 1 is a side view of a first preferred vehicular auger implement 100. As shown and starting from the vehicle and moving outward, it comprises four portions, a vehicular mount 110 that provides an adjustable base 160, a central articulating section 120 formed from a double 4 bar linkage, an auger support and control section 130, and an auger 140. FIGS. 2 to 4 show the vehicular auger implement 100 attached to the rear of an ATV 10, while FIGS. 5 to 7 show the vehicular auger implement 100 attached to the front of a UTV 10'. FIGS. 8A and 8B illustrate the motion constraint provided by the overall implement 100, particularly by the central articulating section 120.

The presently preferred vehicular mount 110 has an adjustable base 160 that comprises a two axis base or a full gimbal base. FIG. 1 depicts the case of an adjustable base 160 provided as a two axis base, one where suitable mechanical arrangements are made to provide a pivotal connection 161 about one axis (e.g. about the longitudinal axis relative to the vehicle or "roll") and a pivotal connection 162 about another axis (e.g. about the lateral axis relative to the vehicle, or "pitch").

FIG. 1B shows an alternative embodiment where a single connecting mechanism 164 provides a full gimbal base 164. In such case, the full gimbal base permits simultaneous rotation in any direction and about any desired axis when released, and then locks in place using, for example, a foot pedal arrangement (not shown).

FIG. 2 shows two arcuate double-arrowed arcs R, P to identify the "roll" and "pitch" motions to be provided by the two-axis base formed by pivotal connections 161, 162, respectively. The pivotal connections 161, 162 can be provided by simple mechanical arrangement involving plates, bolts, etc., or with a more sophisticated arrangement that does not require tools for adjustment. Through this unique arrangement, even when the vehicle is parked on a slope and is not level relative to the earth, an operator can reposition the adjustable base 160 and compensate for that fact before beginning to manipulate the auger bit 142 and bore a vertical hole notwithstanding the slope.

The preferred mount 100 further comprises a proximal tongue 111 that extends horizontally and is sized and shaped (made e.g. of 2"×2" tubing) for sliding and pinned attachment to a vehicle's tow hitch receiver (although other methods of attachment may be employed, including essentially permanent attachment), a vertical section 112, and a distal end 115 that supports the central articulating section 120 and provides a third connection 163 that permits rotation about a third axis (i.e. about a vertical axis relative to the vehicle, or "yaw").

As shown in FIG. 2, the distal end 115 is formed from a support plate 116 welded to the vertical section 112, and two parallel plates 117 that extend from the support plate 116, the parallel plates 117, 117 providing aligned apertures for pivotally receiving a shaft extending from the central articulating section 120. The result is a pivoting connection 163. The central articulating section 120 in turn supports, at its distal end, an auger support and control section 130 including a mounting plate 131 and a handle 132, the mounting plate 131 in turn supporting an auger 140 including a hydraulic motor 141 and an auger bit 142.

The central articulating section 120 being formed from a double 4-bar linkage is a key part of the preferred embodiment. The first 4-bar linkage is generally designated as item 121, and the second 4-bar linkage is generally designated as item 122. As further shown, the first 4-bar linkage is formed by two elongated members connected to a base link 123 and a central link 124. The second 4-bar linkage, in turn, is formed by two elongated members connected between the central link 124 and a distal link 125. In the preferred embodiment, the two 4-bar linkages 121, 122 share the central connecting link 124. In addition, suitable springs or gas shocks 151, 152 are installed, as shown, to aid in the movement of the overall mechanism created by the first and second 4-bar linkages 121, 122.

In any 4-bar linkage, parallel bars necessarily remain parallel to one another as the linkage is moved. Consequently, if a "base" bar of the 4-bar linkage is held vertical, the parallel bar will also remain vertical throughout the entire range of motion of the overall linkage. Here, in this dual 4-bar linkage arrangement 120, the linkage will be movable throughout a predetermined range of motion that is a function of the geometry chosen and, of significance, will tend to guide the auger bit vertically if properly adjusted before drilling.

It is presently contemplated that when the vehicle (ATV, tractor, etc.) is parked on a slope, the auger implement 100 would be prepared for use by coarsely manipulating the mechanism 130 to roughly position the tip of the auger bit 142 over the intended hole, and then manipulating the adjustable base 160 to compensate for the slope. In one possible approach to readying the implement 100 for use, the operator would place a bubble level (not shown) on the flat top of the common link 124 (see FIG. 2), and manipulate the adjustable base 160 until the link 124 is level relative to the earth. The operator may then finely re-position the auger tip. At that point, the pre-positioned, pre-leveled link system 120 will inherently guide the auger bit 142 vertically into and out of the soil all under the guidance of a single operator as suggested somewhat by FIGS. 8A and 8B.

As shown in FIGS. 2, 4, 5, and 7, the preferred auger support and control section 130 comprises a two-way hand control 133 and suitable linkage 134 in order to permit the operator to control the speed and/or direction of the hydraulic motor 141. In the preferred embodiment, the hydraulic motor 141 is reversible in order to make it easier to withdraw the auger bit 142 from the soil or other substrate.

The central articulating section 120 movably connects to the mount's distal pivot connection 115 and, in the preferred embodiment, features a spring or gas shock counter balanced double 4 bar linkage. The spring or gas shock counter balanced arrangement beneficially relieves the single operator from heavy lifting. Moreover, owing to the double 4 bar linkage, the single operator can easily position the auger implement 100 within its range and then keep the auger bit 142 vertical as the bit 142 goes deeper and deeper into the soil (see FIGS. 8A and 8B). FIGS. 8A and 8B show the auger implement 100 being used to bore a vertical hole while the vehicle 10' is on level ground. If the vehicle 10' were parked on a slope, the operator would simply reposition the adjustable base 160 (as suggested by the multi-axis or gimbal arrangement of FIGS. 1 and 1A, or other suitable mechanism) in order to compensate for the slope before boring the hole.

The unit 100 being mounted to a vehicle (e.g. ATV 10 or UTV 10') makes for much safer operation in that the torque induced by the hydraulic motor 141 is resisted by the weight of the vehicle and not the operator. This also allows for the safe use of more powerful hydraulics. An auger implement 100 made according to the embodiment of this new invention is cheaper than a comparable powered auger, safer to use, and much easier to use alone. It is truly a one man operational machine and allows the single operator to work for much long periods as it is less demanding on the operator.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

I claim:

1. An auger implement for vehicular attachment comprising:

a vehicular mount section having an adjustable base, the adjustable base including:

a proximal end piece extending along a longitudinal axis;

a vertical piece having first and second ends, the first end pivotally connected to the proximal end piece, the first end of the vertical piece rotating with respect to a lateral axis, the lateral axis being perpendicular to the longitudinal axis; and a distal end piece extending longitudinally and pivotally connected to the vertical piece at the second end of the vertical piece, the distal end piece rotating with respect to the longitudinal axis;

a central articulating section formed from a double 4-bar linkage and rotatable with respect to a vertical axis, the vertical axis being perpendicular to both the longitudinal axis and the lateral axis, the double 4-bar linkage providing a range of movement along the longitudinal axis, the central articulating section being connected to the distal end piece of the adjustable base at a first end of the central articulation section;

an auger section having a motor and an auger bit driven by the motor; and an auger support and control section connected to the central articulating section and the auger section, the auger support and control section providing an operator handle for guiding the auger section within the range of movement along the longitudinal axis.

2. The auger implement of claim 1, wherein the distal end piece of the adjustable base further includes a support plate being parallel with the lateral axis and at least one parallel plate that extends from the support plate along the longitudinal axis, the at least one parallel plate further including an aperture that is sized and shaped to receive a shaft located on the first end of the central articulating section.

3. The auger implement of claim 1, wherein the vertical piece and the proximal end piece of the adjustable base are connect by a gimbal link.

4. The auger implement of claim 1, wherein the double 4-bar linkage is counter balanced with springs.

5. The auger implement of claim 1, wherein the double 4-bar linkage is counter balanced with gas shocks.

6. The auger implement of claim 1, wherein the auger support and control section further comprises a hand-operated switch for energizing the motor.

7. The auger implement of claim 6, wherein the hand-operated switch is configured for energizing the motor in a forward and in a reverse direction.

8. The auger implement of claim 1, wherein the motor is a hydraulic motor.

9. The auger implement of claim 1, wherein the first end of the central articulating section is counterbalanced by a spring.

10. The auger implement of claim 1, wherein the first end of the central articulating section is counterbalanced by a gas shock.

11. The auger implement of claim 1, wherein the proximal end piece further includes a tongue that is sized and shaped to mate with a vehicular tow receiver.

12. A mobile auger implement, comprising:

an adjustable base including:

a proximal end piece extending longitudinally along a longitudinal axis and sized and shaped for mounting to a vehicle hitch receiver;

a vertical piece pivotally connected to the proximal end piece at a first end of the vertical piece, the vertical piece rotating with respect to a lateral axis, the lateral axis being perpendicular to the longitudinal axis; and a distal end piece extending longitudinally and pivotally connected to the vertical piece at a second end of the vertical piece, the distal end piece rotating with respect to the longitudinal axis;

a central articulating section formed from a double 4-bar linkage, the double 4-bar linkage providing a range of movement along the longitudinal axis, the central articulating section being connected to the distal end piece of the adjustable base at a first end of the central articulation section, the central articulating section further rotating about a third axis, the third axis being perpendicular to the longitudinal axis, the third axis being further defined as the distal end piece rotates about the longitudinal axis;

an auger section having a motor and an auger bit driven by the motor; and an auger support and control section connected to the central articulating section and the auger section, the auger support and control section providing an operator handle for guiding the auger section within the range of movement along the longitudinal axis.

13. The mobile auger implement of claim 12, wherein the adjustable base is configured to be attached to at least one item selected from the group consisting of: an ATV, a UTV, and a tractor.

14. The auger implement of claim 12, wherein the double 4-bar linkage is counter balanced with springs.

15. The auger implement of claim 12, wherein the double 4-bar linkage is counter balanced with gas shocks.

16. An auger implement for vehicular attachment comprising:

a vehicular mount section having an adjustable base, the adjustable base including:

a proximal end piece extending longitudinally along a longitudinal axis;

a vertical piece pivotally connected to the proximal end piece at a first end of the vertical piece, the vertical piece rotating with respect to a lateral axis, the lateral axis being perpendicular to the longitudinal axis;

a distal end piece extending longitudinally and pivotally connected to the vertical piece at a second end of the vertical piece, the distal end piece rotating with respect to the longitudinal axis, and includes a support plate being parallel with the lateral axis and at least one parallel plate that extends from the support plate along the longitudinal axis;

a central articulating section formed from a double 4-bar linkage, the double 4-bar linkage providing a range of movement along the longitudinal axis, the central articulating section being connected to the distal end piece of the adjustable base at a first end of the central articulation section, and wherein the at least one parallel plate further including an aperture that is sized and shaped to receive a shaft located on the first end of the central articulating section;

an auger section having a motor and an auger bit driven by the motor; and an auger support and control section connected to the central articulating section and the auger section, the auger support and control section providing an operator handle for guiding the auger section within the range of movement along the longitudinal axis.

* * * * *